United States Patent [19]

Lambrecht et al.

[11] Patent Number: 4,702,731

[45] Date of Patent: Oct. 27, 1987

[54] THERMOPLASTIC BAG MACHINE

[75] Inventors: Emiel Y. Lambrecht, Gijzegem - Aalst; William Van Der Gucht, Aalst, both of Belgium

[73] Assignee: FMC Corporation, Chicago, Ill.

[21] Appl. No.: 928,742

[22] Filed: Nov. 10, 1986

Related U.S. Application Data

[63] Continuation of Ser. No. 703,000, Feb. 19, 1985, abandoned.

[30] Foreign Application Priority Data

Mar. 27, 1984 [BE] Belgium ..... 212638

[51] Int. Cl.[4] ..... B31B 1/10; B31B 19/18; B31B 19/86; B65H 23/16

[52] U.S. Cl. ..... 493/196; 493/29; 493/926; 226/114; 226/115; 242/75.3

[58] Field of Search ..... 226/113, 114, 115; 242/75.3; 493/24, 29, 196, 926

[56] References Cited

U.S. PATENT DOCUMENTS

| | | | |
|---|---|---|---|
| 3,608,804 | 9/1971 | Swansen | 226/114 |
| 3,663,338 | 5/1972 | Wech | 156/515 |
| 3,722,376 | 3/1973 | Wech | 493/34 |
| 4,114,791 | 9/1978 | Schneider | 229/91 |
| 4,216,705 | 8/1980 | Achelpohl et al. | 493/11 |
| 4,368,051 | 1/1983 | Lehmacher | 493/11 |
| 4,398,903 | 8/1983 | Lehmacher | 493/197 |

*Primary Examiner*—Fredrick R. Schmidt
*Assistant Examiner*—William E. Terrell
*Attorney, Agent, or Firm*—R. E. Parks; D. W. Rudy; R. B. Megley

[57] ABSTRACT

Disclosed is a mechanism, associated with a thermoplastic bag making machine, for preparing a strip of thermoplastic to produce bags having the upper edges of the bag mouth formed in a sinusodial shape such that the peak of such shape is substantially equi-distant relative to the side edges of the bag. While the disclosed bag machine is of the type that advances the web strip incrementally, shaping of the web strip in the sinusodial shape occurs while a portion of the web strip is advanced at substantially constant velocity. A mechanism is provided for maintaining constant tension in the web despite the constant and intermittent feeding of the web.

14 Claims, 13 Drawing Figures

THERMOPLASTIC BAG MACHINE

This is a continuation of application Ser. No. 703,000, filed Feb. 19, 1985, abandoned.

This invention relates to machines for making thermoplastic bags and more particularly to a system of handling thermoplastic web material such that a substantially constant tension is applied to the web being processed.

The bag machine of the present invention is related to bag machines disclosed in U.S. Pat. Nos. 3,663,338 issued May 16, 1972 and 3,722,376 issued Mar. 27, 1973. Both patents, to Robert J. Wech are assigned to the assignee of present application and by reference thereto it is intended that their disclosure be incorporated herein.

In general, intermittent motion bag machines include web drive rolls operative to continually unwind thermoplastic film from a supply roll and intermittently operable web draw rolls for feeding equal increments of film to a sealing and severing device that produces a bag or a web segment which may be further processed to produce a bag or bags.

Since film is continually withdrawn from the film supply roll by drive rolls and film is intermittently advanced by the draw rolls, bag machines are provided with mechanisms for accumulating and tensioning the film to insure feeding of repetitive length of film to thereby produce bags or web segments of equal dimensions and proper operation of accessory devices whose operation requires tensioned film. Mechanisms for accumulating and tensioning film may take a variety of forms but the most commonly used arrangement comprises a plurality of stationary rolls cooperating with a plurality of rolls mounted between dancer arms or links which are spring biased away from the stationary rolls. The film fed by the drive rolls is threaded around all of the rolls in a serpentine fashion. When the draw rolls are stopped during the period allocated to effect sealing and severing of the web, the film fed by the drive rolls is accumulated between the sets of stationary and movable rolls due to the movement of the spring biased arms. In addition, the spring biased dancer arms apply tension to the film on that portion between the drive rolls and the draw rolls.

Principally, as a result of the speed at which most intermittent motion bag machines operate, a condition known as web bounce occurs on commencement of draw roll operation. Web bounce is a result of commencing feeding of the film portion between the stationary rolls and forceably extending or stretching the springs connected to the dancer arms to withdraw the provisionally accumulated film. Inertial forces, derived from the acceleration and deceleration of the draw rolls and the tendency of idler rolls to continue rotation after the draw rolls have been stopped causes variations in web tension which is not proper acocomodated by the tension exerted by the spring biased dancer arms. Negative effects of excess and variable tension are in part due to the type of film being processed, its thickness and the style of bag being produced. Additionally, lack of accurate and consistent tension control presents problems with printed film because to achieve equal increments of web advance printed film is provided with a registration mark which is detected by a photo-sensitive device which provides a signal to the clutch-brake mechanism when the presence of a registration mark is detected. On detection, the clutch is de-energized and the brake is energized arresting movement of the film in order to effect sealing and severing. Excess tension at times causes longitudinal wrinkling of the web which may shroud the registration mark such that it is not, or wrongly, detected by the photosensitive device. Accordingly clutch-brake operation does not occur at the desired interval.

In another aspect, the subject matter of the present disclosure relates to an apparatus and method for producing sinus top handle bags. This aspect is characterized by passing the web over a projected knife which is controllably laterally traversed while the film is fed toward the draw rolls in the bag machine. The knife cuts the tensioned film in a wavy pattern generally along a zone containing the longitudinal median of the continuous web motion film. A bag having its top marginal edges cut in a wavy pattern is referred to as a sinus bag.

By providing a knife which is laterally controllably reciprocated, the line of cut will form a sine wave for all bag sizes with a range of sizes. While the concept lends itself to produce sinus top bags of most desired width, the components for effecting controlled lateral reciprocation are selected to operate within certain size ranges. For example, a machine incorporation the disclosed design is able to produce sinus top bags of widths ranging from 350 to 520 mm.

DESCRIPTION OF THE PREFERRED EMBODIMENT

Figure 1:
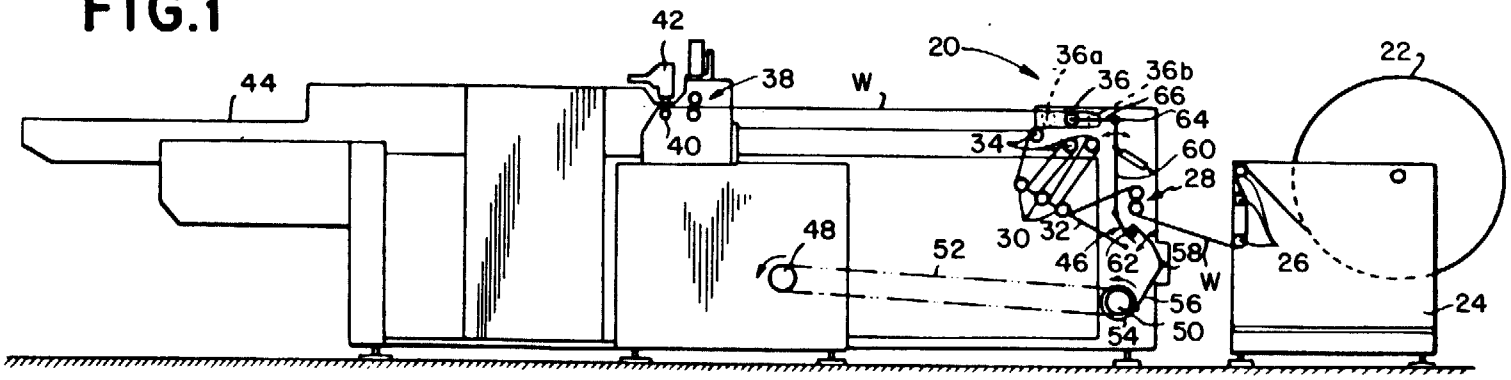
FIG. 1 is an elevation of abag machine incorporating the novel web tension control according to the present invention.

A bag machine incorporating the novel film tension control mechanism in accordance with the present invention is generally indicated by the numeral 20. As shown in FIG. 1, a parent roll of film 22 is mounted for rotation on an unwind stand 24. The film is passed over a set of idler rolls 26, carried by the unwind stand 24, and between web drive rolls 28. From rolls 28, the web is alternatively passed around stationary idler rolls 34 and idler rolls 30 mounted between laterally spaced dancer arms 32. The film, sometimes hereinafter referred to as the web W, is then passed around a transversely extending longitudinally translatable roll 36, whose typical extent of longitudinal translation is depicted at phantom outline positions 36*a* and 36*b*. The web strip W is fed between a pair of opposed draw rolls 38 which are intermittently operable to project a leading portion of the web W between a seal roll 40 and an opposed reciprocating heated bar 42 which is effective to forceably engage the seal roll 40 and effect sealing and severing the web W along a line transverse to the path of the web. This action produces bags or web segments which are transported to a stacking table 44 by stacker belts (not shown) located between the seal roll 40 and the stacking table 44.

In accordance with a principal feature of the present invention, means are provided to supply film from the web roll 22 at a substantially constant rate which is achieved by translating the roll 36 away from the draw rolls 38 beyond the increment of time allocated for operation of the heated bar 42 and to translate the roll 36 towards the draw rolls 38 during a portion of the time the draw rolls are operative to feed a successive increment of web W over and past the seal roll 40. In general it can be said that the translating roll 36 is moving away from the draw rolls 38, for approximately 216° and towards the draw rolls 38, for approximately 144° during one machine cycle. As will be explained in greater detail hereinafter the extent to which the roll 36 is translated toward and away from the draw rolls 38 depends upon the draw length of the web W. In other words, if the bag machine is set up to produce side weld bags, the distance through which the roll 36 is translated is related to the width of the bag being produced. Thus in view of the variable draw lengths which are required by the users, means 46 are provided for varying the distance through which the idler roll 36 is translated. Since the roll 36 is translated in opposite direction during each bag making cycle, its movement is synchronized with the main, motor driven, shaft of the machine. To this end a timing pulley 48 is driven in a 1 to 1 ratio with the main shaft of the machine. Another timing pulley 50 is driven by the pulley 48 by a timing belt 52 and the shaft 68 carrying the pulley 50 also carries a cam 54 that causes oscillation of a bell crank 56 pivotally mounted about the axis of a shaft 58. Oscillation of the bell crank 56 is transmitted to another bell crank 60 through an adjustable roll 62. The bell crank 60 is pivotally connected at 64 to links 66 pinned to the ends of the roll 36.

As thus far described, it will be seen that the cam 54, through the bell cranks 56 and 60, effects synchronized movement of the roll 36 toward and away from the draw rollers 38 during each machine cycle.

Figure 2:
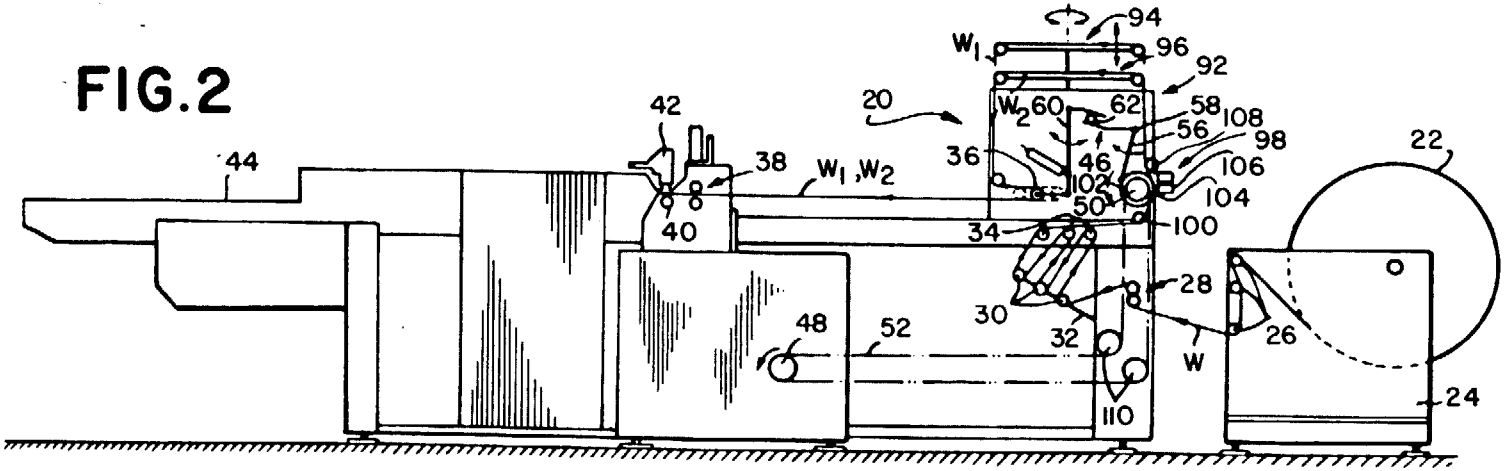
FIG. 2 is also an elevation of a bag machine which not only incorporates the web tension control mechanism but the novel mechanisms for producing a sinus top bag.
Figures 2A, 2B, 3:
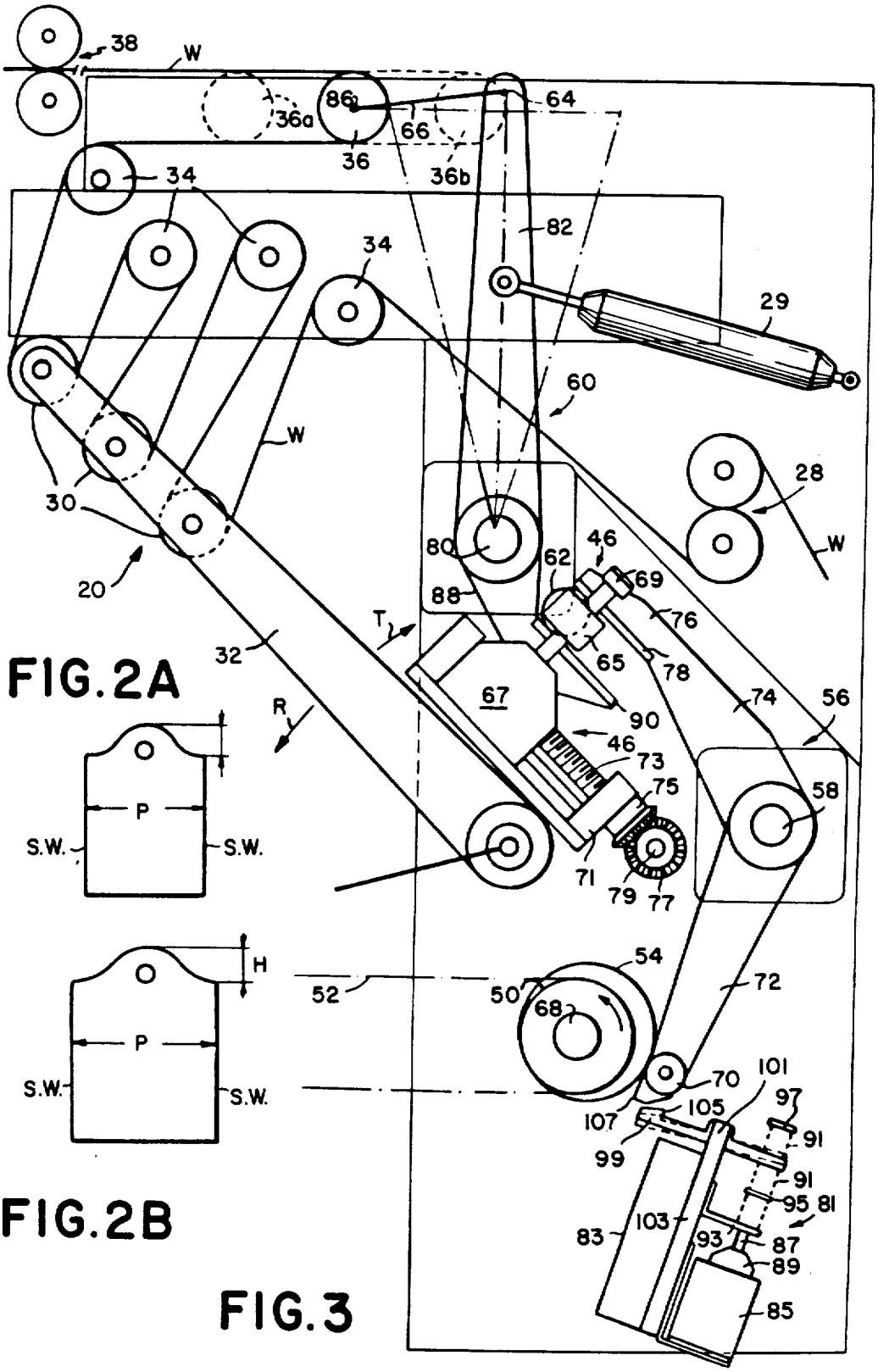
FIGS. 2A and 2B show typical sinus bags produced by the bag machine.
FIG. 3 illustrates constructional details of the tension control system, FIG. 3A show a control for stopping operation of the web tension compensating control.

FIG. 3 is an enlarged view of the means 46 for controlling translation of the roll 36. The cam 54 is provided with a profile that imparts oscillation to the bell cranks 56 and 60 that matches the instantaneous velocity at which the web W is advanced by the draw rolls 38. The draw rolls 38 are intermittently rotated by providing a clutch-brake, not shown, which is operated by a machine-timed signal in the power train. Accordingly the draw rolls 38 commence rotation on energization of the clutch and halt concurrent with the de-energization of the brake. A plot illustrating the velocity of the draw rolls during one cycle of operation takes the general form of a sine wave during a period of 180° of rotation of the main shaft of the machine.

The pulley 50 and the cam 54 are keyed to a shaft 68 which is driven in a 1:1 ratio with the main shaft of the machine. The bell crank 56 is oscillated by the cam 54 through a cam follower roller 70 rotatably mounted on an arm 72 which forms part of the bell crank 56. The bell crank 56 also includes another integral arm 74 having its outward end portion 76 mounting a flat straight hardened insert 78 bearing against the adjustable roll 62 which is also hardened. The roller 62 is adjustable, by means 46 hereinafter described, along the face of the hardened insert 78 and its adjusted position determines the included angle of displacement of the bell crank 60.

The bell crank 60 is mounted for pivotal oscillating movement about the axis of a shaft 80 and is formed with an elongate arm 82 pivotally connected at 64 to the links 66 which are in turn pivotally connected at 86 to the ends of the roller 36. As it will be recalled, the roller 36 is translated, by the action of the bell crank 60, toward and away from the draw rolls 38 and such movement is illustrated in FIG. 3 by the phantom outline positions identified as 36*a* and 36*b*. The bell crank 60 also includes a shorter arm 88 carrying a flat hardened insert 90 facing, and similar to, the insert 78 carried by the arm 74 of the bell crank 56. The roller 62 is adjustably positioned along the passage way formed by the inserts 78 and 90 for the purpose of establishing the included angle of oscillation imparted to the bell crank 60. Such oscillation determines the length of the path in which the translatable roller 36 will tranverse. For example, the included angle of oscillation of the bell crank 56 is always constant since its degree of rocking motion about the shaft 58 is determined by the cam 54. However the included angle of oscillation of the bell crank 60 depends upon the location of the roller 62 with respect to the center of the shaft 58 about which the bell crank 56 oscillates. If the roller 62 is positioned to its limit of adjustment in a direction toward the shaft 80, the elongated arm 82 sweeps through its maximum included angle whereas adjustably locating the roller 62 to its limit in a direction toward the shaft 58 imparts a minimum sweep angle to the elongate arm 82 of the bell crank 60.

The means for adjusting the position of the roller 62 is generally identified by the numeral 46. A bracket 65 rotatably carries the roller 62 and the bracket is connected to a slider block 67 by bolts 69 (only one of which is shown). A vise-like guide 71 supports an elongate screw 73 threaded through the slider block 67 and has a bevel gear 75, meshing with another bevel gear 77 keyed to shaft 79. Shaft 79 is provided with a crank (not shown) that can be actuated by the operator for rotating the shaft 79 to cause rotation of the screw 73 through the bevel gears 77 and 75. Rotation of the screw 73 moves the slider block 67, the bolts 69, the bracket 65, and the roller 62. Thus the operator can position the roller 62 in accordance with the size of the bag being made.

By providing the cam 54 with a profile related to the instantaneous velocity of the draw rolls 38 the motion imparted to the bell cranks 56, and the distance to which the roller 36 is translated toward and away from the draw rolls 38 is accordingly related to the instantaneous velocity of the web W which is fed by the draw rolls.

During that increment of time of a bag machine cycle allocated to effect sealing and severing of the web, the draw rolls 38 are stopped and accordingly feeding of the web W is also stopped. At the time the draw rolls 38 are stopped, or feed slower than the continuously average web speed, feeding of the web by the drive rolls 28 continues, since the drive rolls are driven by a separate motor. The cam 54 causes displacement of the elongate arm 82 in a clockwise direction which in turn displaces the roller 36 away from the draw rolls 38 thus taking-up the web W which is supplied by the drive rolls 28.

The length of the path of reciprocation of the roll 36 is determined by the position of the roll 62 providing the physical connection between the bell cranks 56 and 60. As mentioned previously, when the roller 62 is positioned at one of its limits toward the shaft 80, a maximum arc of oscillation is imparted to the elongate arm 82 whereas when the roller 62 is positioned at its limit toward the center of the shaft 58 a minimum arc of oscillation is imparted to the elongate arm 82. Accordingly when the bag width (for side weld bags) or the bag length (for bottom weld bags) size is the largest the machine can produce, the roller 62 will be positioned as close as possible to the center of the shaft 80. When a minimum dimension of bag is being produced the roller 62 will be positioned as close as possible, within the confines of the inserts 78 and 90, toward the center of the shaft 58.

It follows from the above arrangement of providing the bell cranks 56 and 60 integrated as described, that the web drive rolls 28 can be operated at constant RPM because during the period of the cycle in which the draw rolls 38 are in a state of repose, or are feeding slower than the continuously average speed of the web, the film supplied by the drive rolls 28 to the sets of idler rolls 30 carried by the dancer arms 32 and the stationary idler rolls 34 is taken up by the translatable idler roll 36 which is displaced during this period of the cycle towards the position indicated as **36*b*. During the period of time the draw rolls 38 are rotating faster than the continuously average speed of the web, the compensating roll 36 is translated toward the position 36*a* paying out web which has been taken up while the draw rolls 38 were stopped, or feeding slower than the average speed. Evidence that the roll 62 between the bell cranks 56 and 60 is properly positioned with respect to the increments of web fed by the draw rolls 38 can be determined by mere inspection of whether the dancer arms 32** experience any oscillation.

To illustrate this condition FIG. 3 shows arrow R and T associated with the dancer arms 32. The arrow T indicates rotation in a clockwise direction while R indicates rotation in a counter clockwise direction. In the event the dancer arms 32 tend to or in fact rotate in the direction T when the drawrolls 38 have stopped feeding, it may mean that the roller 62 should be adjusted to assume a position further away from the center of the shaft 80 while movement in the direction of the arrow R may mean that the roller 62 should be adjusted closer to the center of the shaft 80. When the compensating system is properly adjusted the dancer arms 32 would appear to be stationary. Establishing this condition is a visual evidence that the tension of the web is constant and is maintained constant independent of the fact whether the draw rolls 38 are operating or are stopped. The contact pressure of the roller 62 with the hardened inserts 78 and 90 is supplied by a spring 29 and the web tension imposed by the dancer arms 32. It is to be recalled, although not shown in FIG. 3, that the dancer arms 32 are spring biased in the direction of the arrow R. Further details of this construction is shown and described in the above mentioned patents to Robert J. Wech.

Figure 3A:
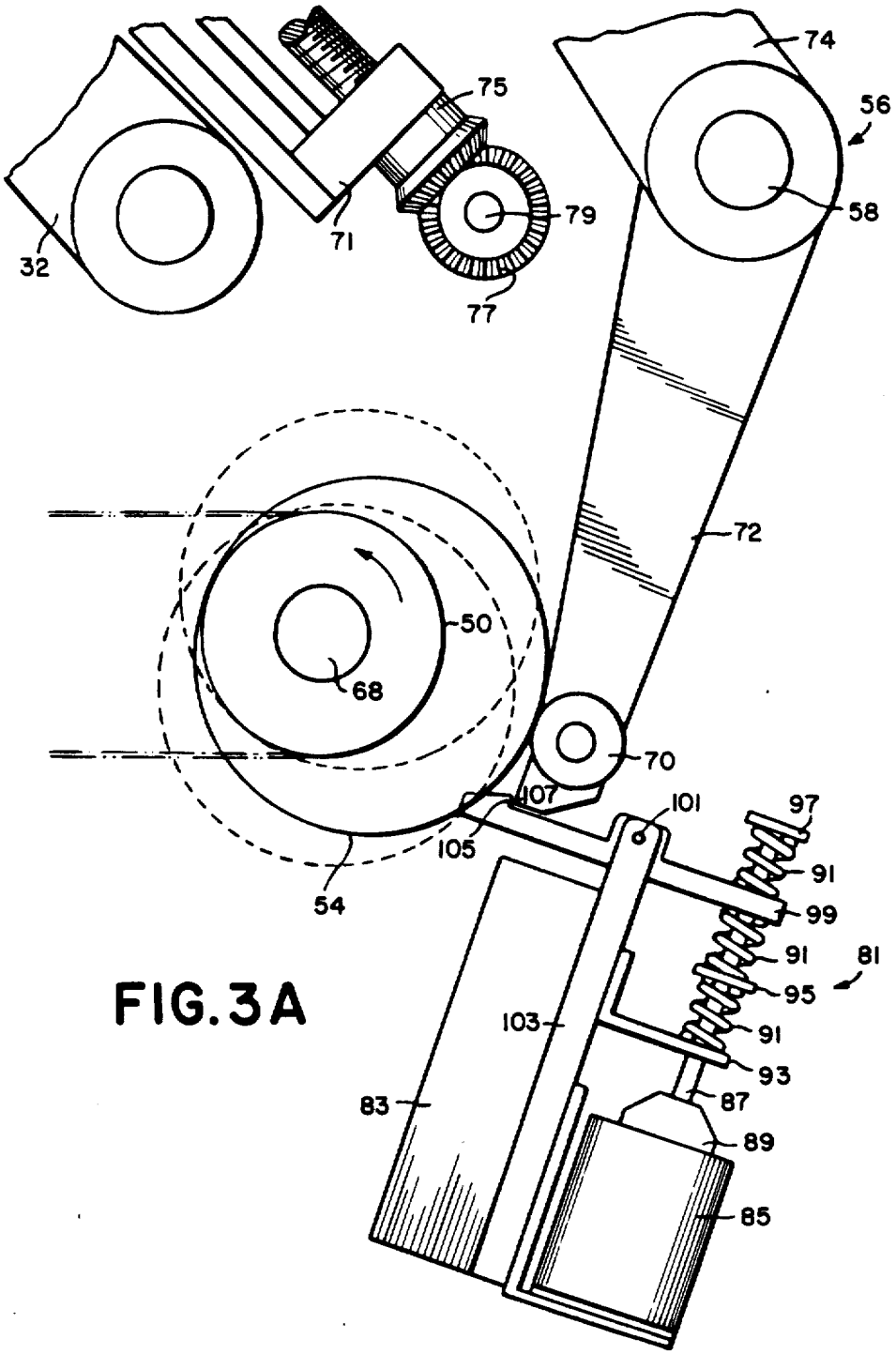

The web tension compensation mechanism shown in FIG. 3 is also provided with means 81 suspending operation of the bell cranks 56 and 60 and thus stop translatory motion of the roller 36. When bag machine operation is suspended for any reason, it is deemed desirable to interrupt operation of the web tension compensating system. The means 81 comprise a bracket 83 attached to the machine frame. The bracket 83 carries a solenoid 85 having a shaft 87 connected to its armature 89. The shaft 87 is supported by a bracket 93 having an opening slidably receiving the shaft 87. The shaft has longitudinally spaced collars 95 and 97 attached thereto and extends through a clearance hole formed in a latch 99 pivotally mounted to a post 103 carried by the bracket 83. Springs 91, between the bracket 93 and collar 95, between the collar 95 and the latch 99 and between the latch 99 and the collar 97, impose axial movement to the shaft 87 and, as a result of solenoid actuation, to the latch 99. The latch 99 is formed with a shoulder 105 that captures and retains the end of the arm 72 and thus suspends oscillation of the bell crank 56. Capturing of the arm 72 is effected when highest point of the cam 54 moves the edge 107 of the arm 72 even with or slightly past the shoulder 105. At that instant, the solenoid 85 is energized moving the shaft 87 downwardly causing the third spring 91 below the the collar 97 to compress the spring 91 to pivot the latch 99 and trap the arm 72 against the shoulder 105. Normal operation is commenced on pivoting the latch 99 by the second spring 91 above the collar 95 thereby withdrawing the shoulder 105 from the arm 72. FIG. 3A shows the latch 99 capturing the arm 72 of the bell crank 56.

FIG. 2 illustrates a bag machine substantially similar to the bag machine shown in FIG. 1 including the novel web tension control system comprising the means 46 to control movement of the translatable compensating roll 36. The web tension control system of the present invention, while of general utility in thermoplastic bag-making machines, is particularly adaptable to produce sinus top handle bags, typical examples of which are illustrated in FIGS. 2A and 2B.

The bag machine shown in FIG. 2 includes an upright vertically extending tower section 92 supporting the tension control system described hereinabove, a pair of offset pivot guides 94 and 96 and a cutting mechanism 98 to produce the wavy sinus pattern cut in the central medial portion of the web W.

The general arrangement and mode of the operation of the cutting mechanism 98, the offset pivot guides 94 and 96 and the tension control mechanism including the translatable roller 36 is as follows. The web as supplied from the web roll 22 is passed from one of the stationary rolls 34 around an idler roll 100 and over a support drum 102 which, as will be explained hereinafter, is provided with a groove having a sinus pattern for receiving a knife 104 carried by a holder 106. Together with the idler roller 100, an idler roller 108 provides a sufficient are of contact of the web on the support drum 102 to effect a clean cut by the knife 104. As the web emerges from the drum 102, it is separated in two strips which are indicated by W1 and W2. Each strip passes over the offset pivot guides 94 and 96 which are set at different elevations for the purpose which will be presently explained.

Figure 4:
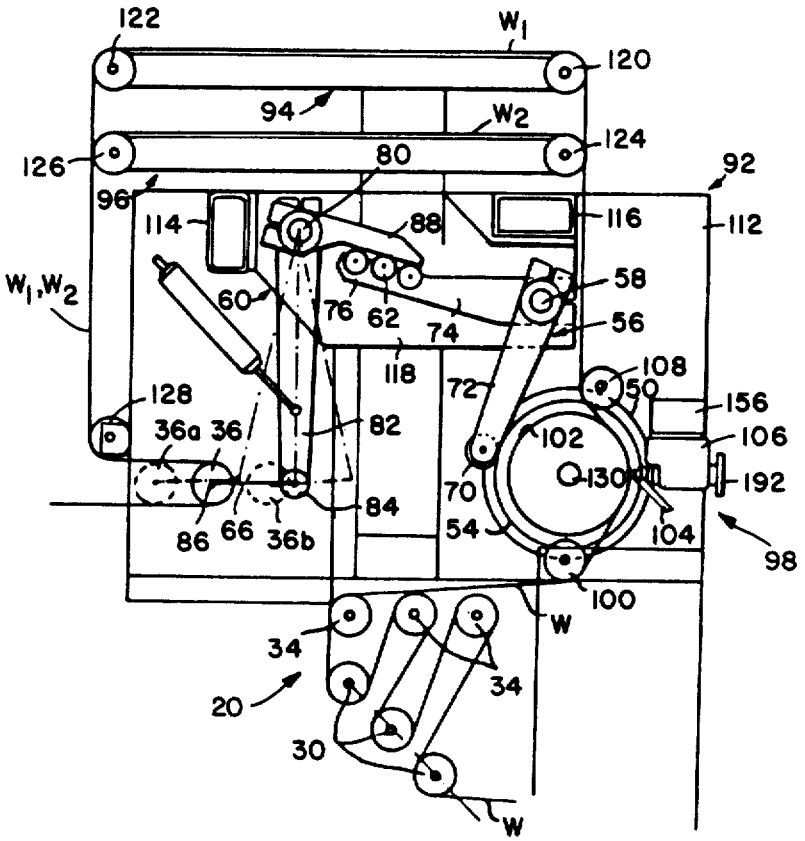
FIG. 4 is an enlarged elevation of the film tension control mechanism being associated with the sinus-forming-cutting mechanism.

FIG. 4 is an enlarged view of a portion of FIG. 2 illustrating further details of the tower section 92. The tower section 92 is formed with laterally opposed upwardly extending side plates 112 (only one of which is shown) being interconnected by transverse box beams 114 and 116. The pivot shafts 58 and 80, mounting the bell cranks 56 and 60, have their mid-sections supported by a plate 118 attached to the box beams 114 and 116. It should be noted that the angular orientation of the arms forming the bell cranes 56 and 60 have been rearranged to be accommodated within the confines of the tower section 92 but their cooperation to achieve continuous controllable translatory motion of the idler roll 36 is the same. As the web passes over the support drum 102 it is slit by the knife 104 into two longitudinal strips being parted along a line defining a sine wave. One strip, W1, is directed over idler rolls 120 and 122 rotatably mounted by the offset pivot guide 94 and the other strip, W2, passes over idler rolls 124 and 126 associated with the offset pivot guide 96. The offset pivot guides perform two functions. Each of the pivot guides can shift the path followed by the web strips laterally away from each other and the upper offset guide 94, by defining a longer path of travel, aligns or phases the sinus wavy pattern of the strip W1 with the wavy pattern of the web strip W2. Each web strip passes over an idler roller 128, attached to the plates 112, then over the translated roll 36 and then the web strips are received between the draw rolls 38.

Figure 6:
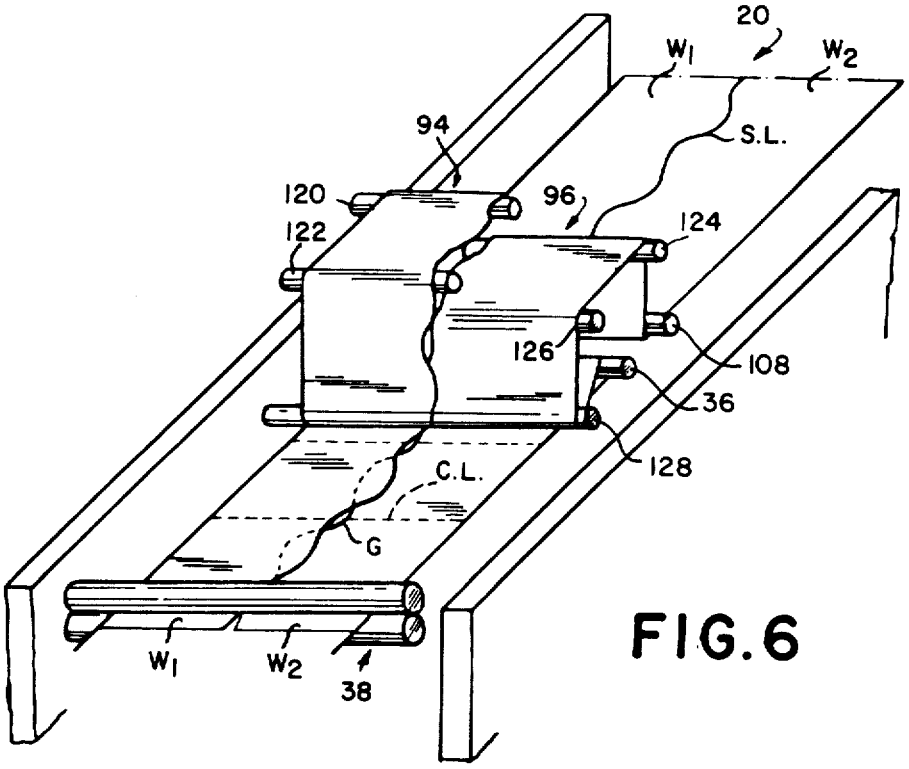
FIG. 6 is a diagramatic of the two web strips produced by the sinus cutter.

A pictorial representation of the operation of the offset pivot guides 94 and 96 is shown in FIG. 6, where it will be observed that the web is parted into two web strips W1 and W2 by a wavy sinus shaped line S.L. In providing two webs strips, and recognizing the fact that when the heated bar 42 descends to seal and sever the web overlying the platten roll 40, it is the object to produce two bags during actuation of the heated bar 42. As the cut line S.L. is wavy or sinus shaped, failure to retard one web strip relative to the other would produce bags having its top edge with a depression between its side margins rather than an elevation as required to achieve a sinus cut bag having hand-receiving holes cut therein. Accordingly, and as illustrated in FIG. 6 the offset pivot guide 94 sufficiently retards movement of the web strip W1 so that its cut edge is aligned with the cut edge of the web strip W2. Additionally the web strip W1 is moved laterally relative to the web strip W2 to produce a gap G. The line along which the heated bar will seal and sever the web intersects the gap G and is represented by C.L. In this manner, each time the heated bar is actuated to seal and sever the web, two identical sinus top bags are produced.

It should be appreciated that the web passing over the support drum 102 is in continuous motion since interruption of web feed to effect sealing and severing by the heated bar 42 does not require interruption of web movement since during that interval of time the compensating translatable roller 36 is moving toward the phantom outline position 36*b*. Accordingly the cutting action of the knife 104 is smooth and continuous and as a consequence produces an accurate and clean cut.

Figure 5:
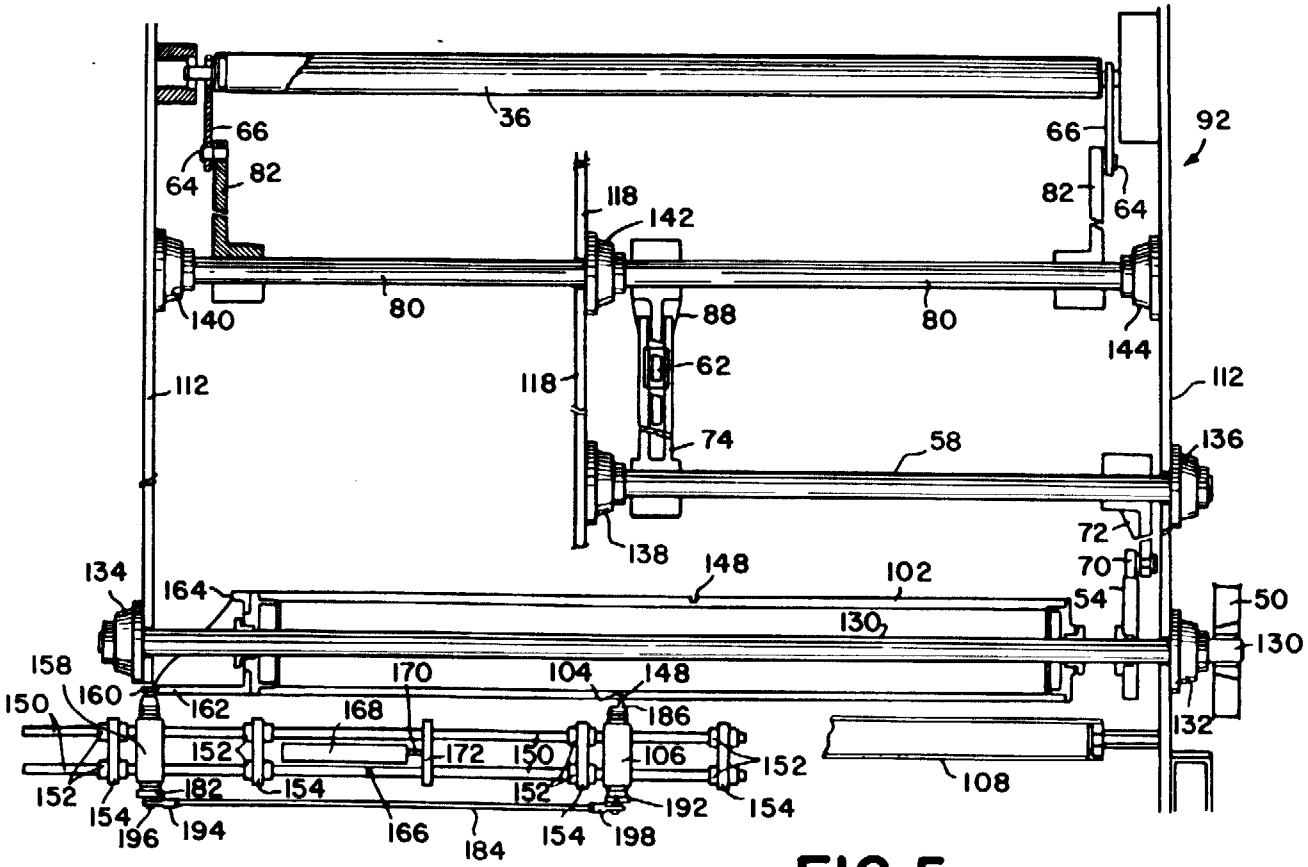
FIG. 5 is an enlarged transverse elevation illustrating constructional details of the sinus cutting mechanism and mechanisms involved in effecting concurrent operation of the film tension control device.

FIG. 5 is a transverse elevation of the web tension compensating mechanism adapted for use in producing sinus top bags. A brief explanation of the modified form of the system of actuating the translatable roll 36 will assist in understanding that its mode of operation is substantially identical to that which has been described and illustrated in FIG. 3.

The timing pulley 50 is mounted on a shaft 130, rotatably mounted in bulkhead bearings 132 and 134 carried by the plates 112. The rotational speed of the shaft 130 is equal to the rotational speed of the main shaft of the bag machine, thereby rotating the support drum 102, which is fixed to the shaft 130, at the same speed. The cam 54 is also fixed to the shaft 130, and by virtue of the cam follow roller 70 carried by the arm 72, the shaft 58, mounted in bearings 136 and 138, is oscillated through an are which is substantially the same as that shown in FIG. 3. The arm 74 is also rigidly attached to the shaft 58 and the rocking motion imparted to the shaft 58 is transferred, through the roller 62, to the arm 88 fixed to the shaft 80 mounted in bearings 140, 142 and 144. It will be observed that the shaft 80 extends from one plate 112 to the other. Arms 82 are keyed or suitably fixed to the shaft 80 closely adjacent the bearings 140 and 144 and are pivotaly connected to the link 66 by pins 64. It should be readily apparent that the compensating system of the present invention, as arranged for use in the environment shown in FIG. 5, has been modified to the extent of providing bell cranks wherein the arms, e.g. 72 and 74, are fixed to a common shaft 58. In like manner the arm 88 operates and transfers its motion to the arms 82 since they are all commonly connected to the shaft 80.

The web cutting system of the present invention fulfills the object of producing the sinusodial pattern for all bags within the range of sizes the bag machine will produce. To illustrate, and as indicated by the different bag sizes shown in FIGS. 2A and 2B, assume that the smallest bag which can be produced by a particular machine is indicated in FIG. 2A by the dimension P which extends from one side weld to the other. The side welds are indicated by the letter SW. The height or peak of the curve from the intersection top end of a side weld to the maximum point of the curve is indicated by the dimension H. Regardless of the width of the bag selected for production, the dimension H remains constant while the sinusodial shape, as the dimension P increases, is stretched out or, stated differently, the period of the wave between the side welds is increased while maintaining the amplitude (H) constant. Accordingly the cutting mechanism of the present invention fulfills the objective of constant movement of the web past the knife 104 and producing the desired sinus cut pattern for all size bags within the minimum and maximum draw length of the machine.

The drum 102, as illustrated in FIG. 4, provides support or a backing for the web during cutting as it progresses between the idler rolls 100 and 108. The support drum 102 is provided with a slot 148 (FIG. 5) of a depth suitable for projecting the knife 104 beyond the piles of the web material passing thereover. The slot 148 takes a wavy pattern which, when stretched out or constructed in a plane, defines the desired sinusodial pattern. It should be noted that the slot 148 is considerably wider than the thickness of the knife to fulfill a purpose which will be particularly described hereinafter. A knife holder 106 is adjustably fixed to a pair of elongate spaced guide rods 150, each of which is mounted in sets of linear bearings 152 carried in brackets 154 which are secured to the box beam 156 (FIG. 4) extending between the side plates 112. Also releaseably attached to the guide rods 150 is a housing 158 rotatably mounting a cam follower rollers 160 in rolling engagement with a cam 162 attached to the shaft 130 which also carries the support drum 102. The profile of the cam 162 is substantially identical to the slot 148 since the transverse motion of the housing 106 carrying the knife 104 is derived from the motion imparted to the cam follower rollers 160 by the cam 162. This motion is transmitted to the rods 150 since the housing 158 and 106 are clamped to the rods 150. To maintain the cam follower rollers 160 in forceable contact with the camming surface 164 of the cam 162, a biasing device 166, which may be a mechanical or pneumatic spring, is contained within a cylindrical housing 168 provided with an output rod 170 fixed to a cross head 172 which in turn is fixed to the rod 150 by set screws or other equivalent means. Accordingly, as the rods 150 are reciprocated by the cam 162 the biasing device 166 maintains the cam follower rollers in pressure engagement with the camming surface 164 and of course transverse motion is imparted to the knife carrying housing 106 since it also is clamped to the rods 150.

Figure 7:
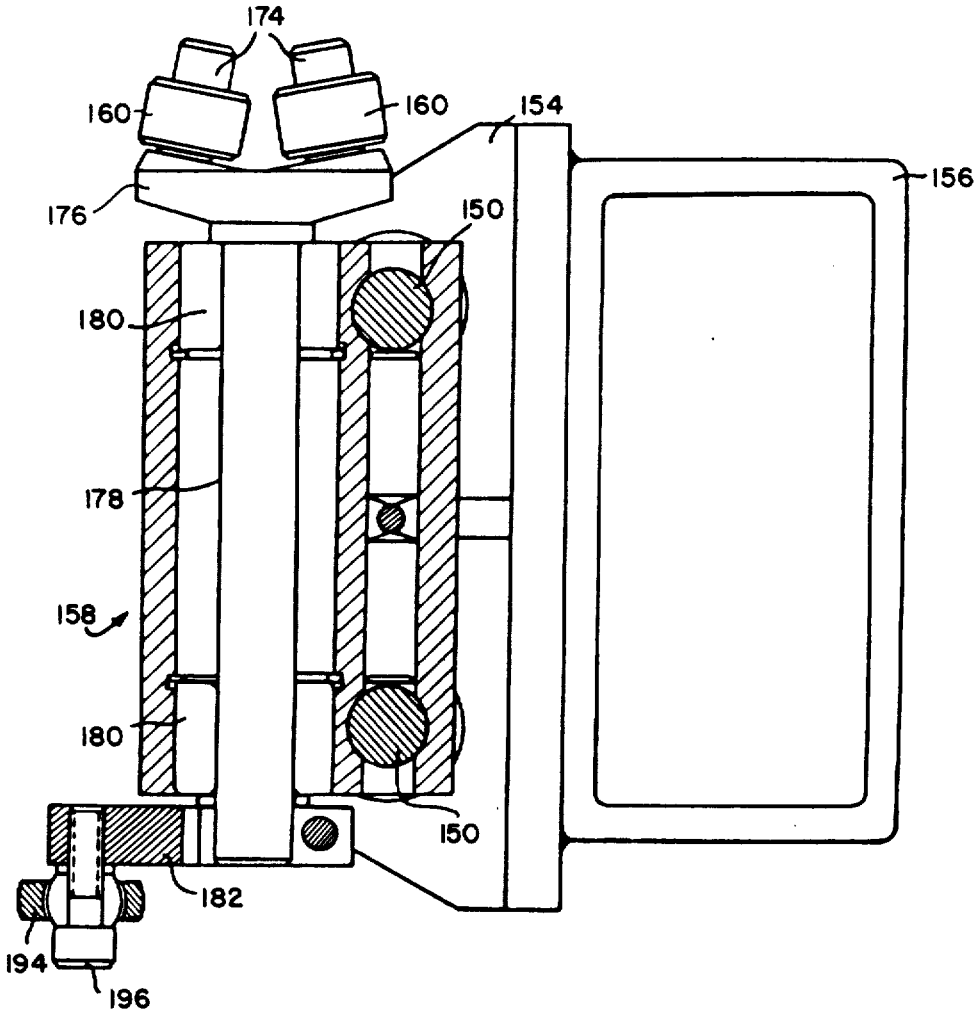
FIG. 7 is a detailed illustration of an assembly mounting cam follower rollers.

FIG. 7 is an enlarged view, partly in section, of the housing 158 carrying the cam follower rollers 160. The two cam follower rollers 160 are rotatably mounted on short stub shafts 174 carried by a cross head 176. The cross head 176 is made integral with or secured to a shaft 178 rotatably mounted in the housing 158 by bearings 180. The shaft 178 extends beyond the housing 158 and has clamped thereon a lever 182. By providing two cam follower rollers 160 in contact with the camming surface 164 the shaft 178 is oscillated as the follower rollers 160 transverse the camming surface 164. This oscillating motion, imparted to the shaft 178 and the lever 182 secured thereon, is transferred to the knife 104 by means of an adjustable length link 184 (FIG. 5) so that the motion of the knife 104 is oriented substantially tangentially with the general sinus cut of the web. It should be appreciated that maintaining a substantially targential condition of the knife 104 to the line of cut varies in accordance with the width of the bag. For example, in making the narrowest bag, as shown in FIG. 2A, the maximum slope of the sinus pattern is approximately 45° whereas in making the widest bag (FIG. 2) the maximum slope may be approximately 35°.

Figure 8:
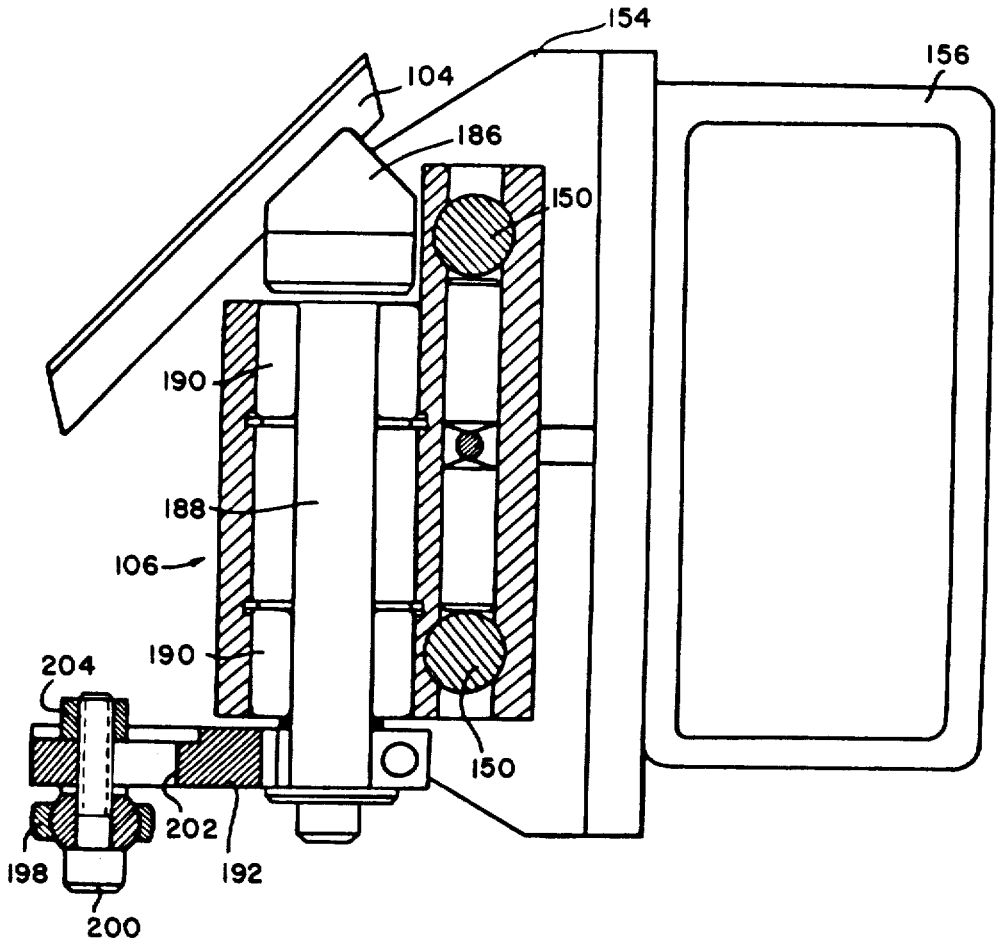
FIG. 8 illustrates details of the knife holding assembly.

As shown on FIG. 8 the housing 106 supporting the knife 104 comprises a knife holder 186 which may be provided with a slot and a suitable clamp for retaining the knife 104. The knife holder 186 is integral with a shaft 183 mounted in bearings 190 carried by the housing 106. As illustrated, the shaft extends beyond the housing 106 and also has a lever 192 clamped thereon. The adjustable length link 184 has each of its ends threaded and threadedly attached to a ball clevis 194 connected to the lever 182 by a fastener 196 (FIG. 5) and to the lever 192 by another ball clevis 198 by a fastener 200. The lever 192 is formed with a slot 202 in which the fastener 200 can be repositioned toward or away from the axis of the shaft 188. The adjusted position of the faster 200 can be maintained by a nut 204.

According to the above described construction, it should be readily appreciated that the rocking motion of the shaft 178 carrying the cam follower rollers 160 is transferred by the lever 182 and by the link 184 to the shaft 188 by virtue of the lever 192 which is clamped thereon. By this means the inclination of the knife 104 is continually adjusted to remain substantially tangent with the point of the sinus curve being generated.

The movement of the fastener 200 in the slot 202 serves to maintain the tangent condition of the knife 104 in accordance with the width of the bag being produced. As mentioned above the width of the bag determines the "period" of the generalized sinus wave and accordingly the instantaneous slope of the knife is continually adjusted.

The illustrated position of the fastener 200 is at a maximum distance from the axis of the shaft 188. In this position the machine is adjusted to produce the longest width bag with the maximum instantaneous slope of the knife adjusted to be about 35°. By repositioning the fastener 200 to the other extreme of the slot 202, that is, closest to the axis of the shaft 188, the maximum instantaneous slope of the knife 104 is adjusted to be approximately 45°. In adjusting the position of the fastener 200 the length of the link 184 is appropriately adjusted at a point of the curve, preferably the valley, where the slope is zero so that a plane containing the axes of the cam follower stick shaft 174 is perpendicular to the guide rods 150 and the plane of the knife 104 is therefore also perpendicular to the guide rods.

Figures 9, 10:
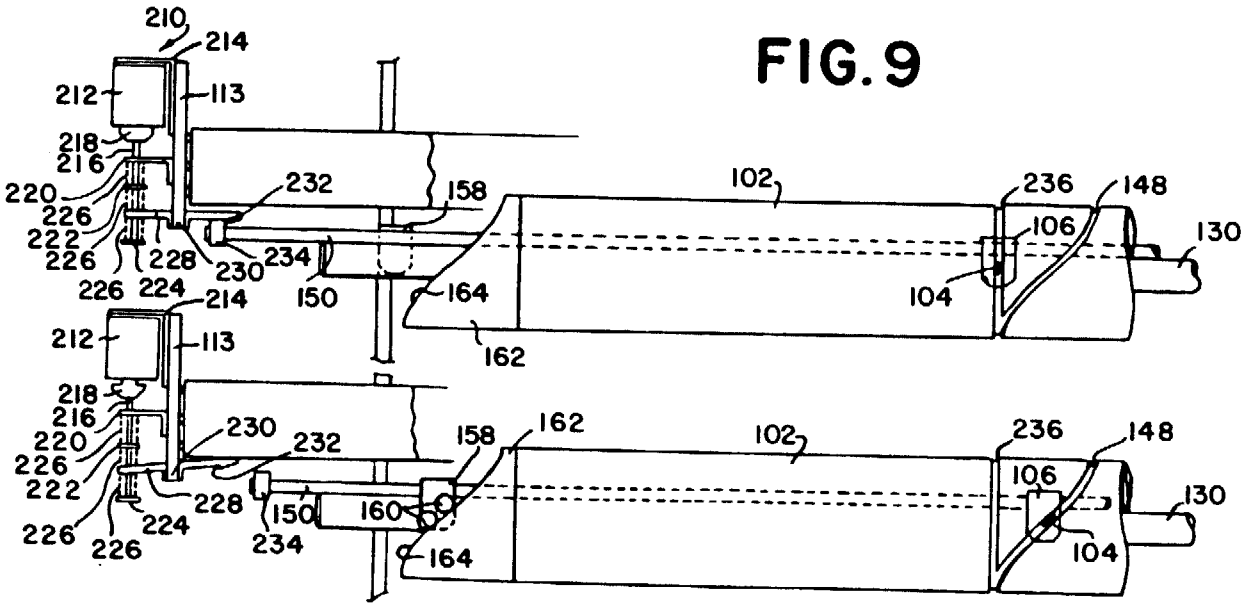
FIGS. 9 and 10 show a control device for stopping operation of the sinus cutter.

When occasions arise dictating arresting web movement across the support roll 102, means 210 are provided for rendering housing 158, carrying the cam follower rollers 160, from following the profile 164 of the cam 162. Such means are shown in FIGS. 9 and 10 and comprise a solenoid 212 mounted on a stationary plate 113 by a bracket 214. An elongate rod 216 is fixed to the armature 218 of the solenoid 212 and is freely extends through an opening formed in a supporting bracket 220. The shaft 216 also extends through a clearance hole formed in a latch 228 which is pivoted at 230 to the plate 113. The latch is formed with a shoulder 232 that can engage a collar 234 carried by the guide rods 150.

Collars 222 and 224 are fixed to the shaft 216 and serve to retain springs 226, between the bracket 220 and the collar 222, between the collar 222 and the latch 228 and between the latch 228 and the collar 224. The springs 226 transfers, on energization of the solenoid 212, the reciprocating motion of the shaft 216 to the latch 228.

Stopping of the reciprocating motion of the guide rods 150 occurs at one point during rotation of the support drum 102 and that point is where the cam follower rollers pass the high point of the camming surface 164. In response to a machine timed signal the solenoid 212 is energized rocking the latch toward the guide rods 150 thus allowing the shoulder 232 to engage and retain the collar 234. Reciprocating of the guide rods 150 stops.

During the time the guide rods 150 are in repose the knife 104 resides within a circumferential groove 236, contained in a plane normal to the axis of the shaft 130 since the normal traversing movement of the knife is arrested. On resuming normal operation the knife again follows the path defined by the slot 148 since the cam follower rollers 160 again follow the profile of the cam 162.

Although the best mode contemplated for carrying out the present invention has been herein shown and described, it will be apparent that modification and variation may be made without departing from what is regarded to be the subject matter of the invention.

What is claimed is:

1. A bag making machine for making bags from maintaining substantially constant tension in a flattened tubular web of thermoplastic material, comprising means for intermittently making bags from said web, a pair intermittently operating draw rolls for intermittently feeding the web to said bag making means, means for continuously advancing the web towards said draw rolls, dancer arm and roll means biased in one direction against tension in the web for accumulating the web in serpentine fashion between said continuously advancing means and said intermittently operating draw rolls, wherein the improvement comprises:

an idler roller along the path of the web between the draw rolls and the dancer arm and roll means, means for synchronously moving the idler roller in one longitudinal direction in timed relation with the non-operating periods of the draw rolls for accumulating the web advancing from the dancer arm and roll means and for synchronously moving the idler roller in another longitudinal direction in timed relation with the operating periods of the draw rolls for paying out the web advancing from the dancer arm and roll means thereby maintaining tension in the web between the dancer arm and roll means and the draw rolls, whereby the serpentine web portion is maintained at a substantially constant length thereby maintaining substantially constant tension in the web.

2. The invention according to claim 1, wherein the synchronously moving means comprises a lever arm linkage means connected to the idler roller for translating the idler roller in opposite longitudinal directions, and a cam means for operating the lever arm means.

3. The invention according to claim 2, wherein the lever arm linkage means comprise two cooperating double arm levers, one arm of one lever engaging the cam, one arm of the second lever pivotally connected to the idler roller, the other arms of both lever having facing fulcrum bearing surfaces, and means between the fulcrum bearing surfaces for adjusting the longitudinal translation of the idler roller.

4. The invention according to claim 3 wherein the adjusting means comprise a motion transferring pivot movable between the fulcrum bearing surfaces of the cooperating double arm levers to establish displacement of the second lever

5. The invention according to claim 4 wherein the pivot comprises a roller connected to a screw means for moving the roller to an adjusted position between the fulcrum bearing surfaces of the double arm levers.

6. The invention according to claim 5 further comprising means for locking the one arm of the one lever for interrupting oscillation of the double arm levers.

7. Apparatus for making bags from a flattened tubular web of thermoplastic material, comprising:

drive roll means for feeding the web material at a constant predetermined average speed from a supply roll, a first dancer means downstream from the drive roll means biased in one direction against the web for tensioning the web material advancing from the drive roll means, draw roll means downstream from the first dancer means for intermittently feeding a selected length of the web material, a means downstream from the draw roll means for sealing and severing the web to make bags from the web received from the draw roll means, and second dancer means synchronized with the draw roll means and located between the first dancer means and the draw roll means for accumulating the web upstream of the draw roll means during a non-operating or slower than the average speed period of the draw roll means and for paying out the web upstream of the draw roll means during a higher than the average speed period of the draw roll means to maintain the web advancing from the first dancer means in substantially constant tension, the second dancer means comprising two interacting double arm bell cranks. One arm of one bell crank bearing against a cam, the other arm of the one bell crank cooperating with one arm of the second bell crank and the other arm of the second bell crank connected to an idler roller in contact with the web, the cam operating the bell crank arms for displacing the idler roller in one direction during periods of web repose and during web speeds slower than the constant average speed, and in an opposite direction during web speeds higher than the constant average speed, the cam having a profile matching the instantaneous speed at which the web is advanced by the draw roll means whereby the bell crank arms impart a continuously controllable motion to the idler roller.

8. The invention claimed in claim 7, further including means between the first and second dancer arms for producing sinus top bags from the web material intermittently feeding to the bag making machine and comprising a support drum downstream of the first dancer means over which web material passes in continuous movement, cutting means for cutting the web lengthwise as it passes over the support drum, and means for traversing the cutting means axially of the support drum to produce a generally sinusoidal line of cut in the web.

9. The invention claimed in claim 8 wherein means are provided between the cooperating arms of the bell cranks for varying the displacement distance of the idler roller for permitting feeding of differing selected lengths of the web material, the varying means comprising a roller located between and selectively movable along facing surfaces of the cooperating arms of the first and second bell cranks for changing the angle of oscillation and hence the distance over which the idle roller is displaced.

10. The invention claimed in claim 9, wherein means are provided to give a longer path of travel for one of the web strips than the path of travel for the second web strip for aligning or phasing the sinusoidal cuts of the two strips, the phasing means comprising a pair of offset pivot guides, one elevated above the other, laterally shifting the path followed by the web strips and aligning and overlapping concave up and concave down cut edges of the sinusoidal cut web strips for producing a gap between the facing concave down cut edges of the web strips through which the web strips are sealed and severed into two identical sinus top bags by the bag making machine, the idler roller of the second dancer means positioned downstream of the pivot guide for maintaining the aligned and overlapping strips in the web repose period downstream of the draw roll means in substantially constant tension.

11. The invention claimed in claim 9, wherein the traversing means comprise a cam and cam follower rollers mounted in a housing (158) secured to a pair of guide rods, the cam being effective through the guide rod to impart traversing motion to the cutting means.

12. The invention claimed in claim 11, wherein the cutting means is pivotally supported in a housing therefor, and means is provided to oscillate the cutting means in synchronism with the rotation of the support drum so that the motion of the cutting means is orientated substantially tangentially with the general sinusoidal line of cut in the web.

13. The invention claimed in claim 12, wherein the cutting means is a knife and the support drum is provided with a circumferential slot to enable the knife to project through the web material, the slot having a wavy pattern which, when stretched out or constructed in a plane, defines the desired sinusoidal pattern.

14. The invention claimed in claim 13, wherein the slot is considerably wider than the thickness of the knife.

* * * * *

UNITED STATES PATENT AND TRADEMARK OFFICE

CERTIFICATE OF CORRECTION

PATENT NO. : 4,702,731

DATED : October 27, 1987

INVENTOR(S) : Emiel Y. Lambrecht and William Van Der Guht

It is certified that error appears in the above-identified patent and that said Letters Patent are hereby corrected as shown below:

Claim 1, Column 10, lines 64 and 65, delete "maintaining substantially constant tension in";

Claim 7, Column 12, line 6, change ". One" to --, one--.

Signed and Sealed this

Twenty-eighth Day of June, 1988

*Attest:*

*Attesting Officer*

DONALD J. QUIGG

*Commissioner of Patents and Trademarks*